United States Patent [19]

Jackson

[11] 4,231,296

[45] Nov. 4, 1980

[54] THREE-TRUCK HIGH ADHESION LOCOMOTIVE

[75] Inventor: Keith L. Jackson, Granite City, Ill.

[73] Assignee: General Steel Industries, Inc., St. Louis, Mo.

[21] Appl. No.: 911,985

[22] Filed: Jun. 2, 1978

[51] Int. Cl.[2] ..... B61C 3/00; B61F 3/06; B61F 5/08; B61F 5/16

[52] U.S. Cl. ..... 105/136; 105/167; 105/196; 105/199 F; 105/199 R; 105/210

[58] Field of Search ..... 105/133, 136, 185, 199 F, 105/199 R, 165, 167, 196, 210

[56] References Cited

U.S. PATENT DOCUMENTS

| | | | |
|---|---|---|---|
| 1,723,720 | 8/1939 | Buchli | 105/133 X |
| 2,829,605 | 4/1958 | Kell et al. | 105/185 |
| 3,547,046 | 12/1970 | Lich | 105/199 R |
| 3,651,766 | 3/1972 | Lich | 105/136 |
| 3,693,553 | 9/1972 | Lich | 105/199 F X |
| 3,738,283 | 6/1973 | Burgess | 105/199 R X |
| 4,088,080 | 5/1978 | Jackson | 105/199 R X |

*Primary Examiner*—John J. Love
*Assistant Examiner*—Howard Beltran
*Attorney, Agent, or Firm*—F. Travers Burgess

[57] ABSTRACT

A railway locomotive has three power trucks with the end trucks each having a bolster resiliently supported on the truck frame and connected to the underframe by cooperating vertical axis pivot-forming means, the middle truck bolster being connected to the underframe by a Watts linkage arranged to directly transmit longitudinal forces from the bolster to the underframe while accommodating substantial excursions of the bolster and middle truck frame transversely of the locomotive underframe for operation of the locomotive on the curved track. To prevent substantial axle-to-axle load transference on each of the trucks, each of the bolsters supports the locomotive underframe by opposed sliding surfaces spaced apart a substantial distance lengthwise of the locomotive and each of the bolsters is connected to the respective truck frame by traction transmitting means constructed to transmit the longitudinal traction forces from the truck frame to the bolster and thence to the underframe effectively substantially at rail level.

21 Claims, 12 Drawing Figures

THREE-TRUCK HIGH ADHESION LOCOMOTIVE

BACKGROUND OF THE INVENTION

1. Field of the Invention

The invention relates to railway rolling stock and consists particularly in a locomotive having three or more trucks constructed to minimize axle-to-axle load transference.

2. The Prior Art

The prior art discloses locomotives having three or more trucks spaced apart lengthwise of the locomotive, as exemplified by C. W. Kell et al. U.S. Pat. No. 2,829,605, in which all of the trucks include truck frames spring supported on a pair of axles and supporting the locomotive underframe by a transversely movable bolster having a swivel connection to the underframe, the end truck bolsters having centering devices such as springs for biasing the bolster to a centered position and thereby maintaining the ends of the locomotive substantially centered transversely of the truck, the intermediate truck bolster or bolsters being arranged for substantially more free play transversely of the truck to permit the center truck or trucks to move outwardly on curved track arcs between the pivot points of the end trucks, even though the center line of the rigid locomotive underframe defines a chord of the same arc. In conventional truck suspensions, such as that of the Kell et al patent, transmission of traction forces at a relatively high level, i.e., at the level of the center plates, such that traction forces applied to the truck at rail level act through a moment arm equal to the height of the underframe bearing plate from the rail tending to tilt the front of the truck upwardly and the rear downwardly, relieving the load on the front axle and increasing the load on the rear axle. Various means have been utilized in the prior art in two truck locomotives for making the effective level of traction force transmission substantially at rail level, as exemplified by Richard L. Lich U.S. Pat. No. 3,547,046, in which a pair of inclined draft links at each side of the truck are arranged so that their projections converge substantially at rail level with their upper ends connected to the locomotive underframe and their lower ends connected by a suitable linkage to a truck part. With such an arrangement, limited lateral movement of the underframe with respect to the truck, desirable for cushioning lateral shocks applied to the wheel flanges by transverse irregularities in the track, can be accommodated through pivotal play in the ends of the links.

Another means utilized in the prior art in two truck locomotives for bringing the level of traction transmission to rail level, as exemplified by Richard L. Lich U.S. Pat. No. 3,693,553, has been to support a truck bolster on the truck frame by means of elastomeric pads supported on the truck frame in longitudinally spaced relation with each other, the pads at each side being inclined longitudinally of the truck in opposite directions such that their normals intersect substantially at rail level. The bolster in turn supports the truck frame on sliding bearings, at least two of which are spaced apart longitudinally of the truck to stabilize the bolster against tipping of the locomotive underframe and a vertically unloaded king pin provides a swivel and traction transmitting connection between the bolster and the underframe. With such an arrangement limited lateral movements of the underframe with respect to the truck for the purpose of cushioning lateral shocks applied to the wheel flanges by transverse irregularities in the track are accommodated through shear transversely of the truck in the bolster mounted elastomeric pads.

In both the link type and elastomeric pad devices for lowering the level of traction force transmission to rail level, sufficient lateral movement of the underframe can be accommodated through the pivotal connections of the links or shear in the pads to cushion the lateral shocks applied to the wheel flanges by the rails, but if such trucks were applied to three-truck locomotives, the much larger transverse excursions required for the intermediate truck during operation on curved track could not be accommodated readily by the pivotal connections of the links or by transverse shear in the bolster supporting pads of the prior art.

SUMMARY OF THE INVENTION

The invention provides three or more truck locomotives with trucks having minimal axle-to-axle load transference. The invention further provides three or more axle locomotives with trucks in which axle to axle load transference is minimized by lowering the effective level of the traction force transmission substantially to rail level or as close thereto as possible. The invention achieves the above objectives by providing each of the three or more trucks with a bolster arranged for non-tipping supporting relation with a locomotive underframe, supporting the bolsters on the respective truck frames for transmission of longitudinal forces between the truck frames and the respective bolsters substantially at rail level, providing a fixed swivel center between the bolsters of the end trucks and the locomotive underframe, and a connection between the intermediate truck and the locomotive underframe for transmitting longitudinal forces directly therebetween while accommodating substantial lateral excursions of the intermediate truck bolster with respect to the underframe. To this end, the intermediate truck bolster is connected to the underframe by a Watts linkage consisting of a transversely extending lever fulcrumed either on the bolster or on the underframe with its ends connected respectively to the underframe or the bolster by longitudinally extending links extending in longitudinally opposite directions from the respective ends of the lever.

DETAILED DESCRIPTION OF THE INVENTION

The letter B indicates a locomotive body having an underframe U supported at its ends on a pair of end trucks generally indicated at 1 and on an intermediate truck generally indicated at 3. Each of the trucks is constructed as will be seen in greater detail hereinbelow to provide for transmission of traction forces substantially at rail level from the truck to the locomotive body so as to virtually eliminate any vertical moment arm through which these forces would otherwise tend to tip the spring-supported truck structure about a transverse axis and thereby increase the load on one of the truck axles and proportionately decrease the load on the other truck axle.

Figure 1:
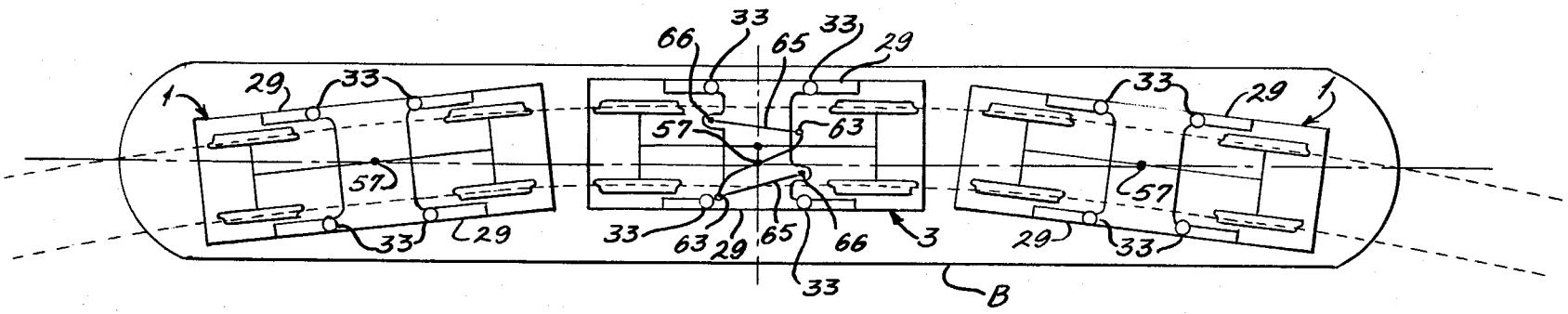
FIG. 1 is a schematic plan view showing a locomotive incorporating the invention on curved track.
Figure 2:
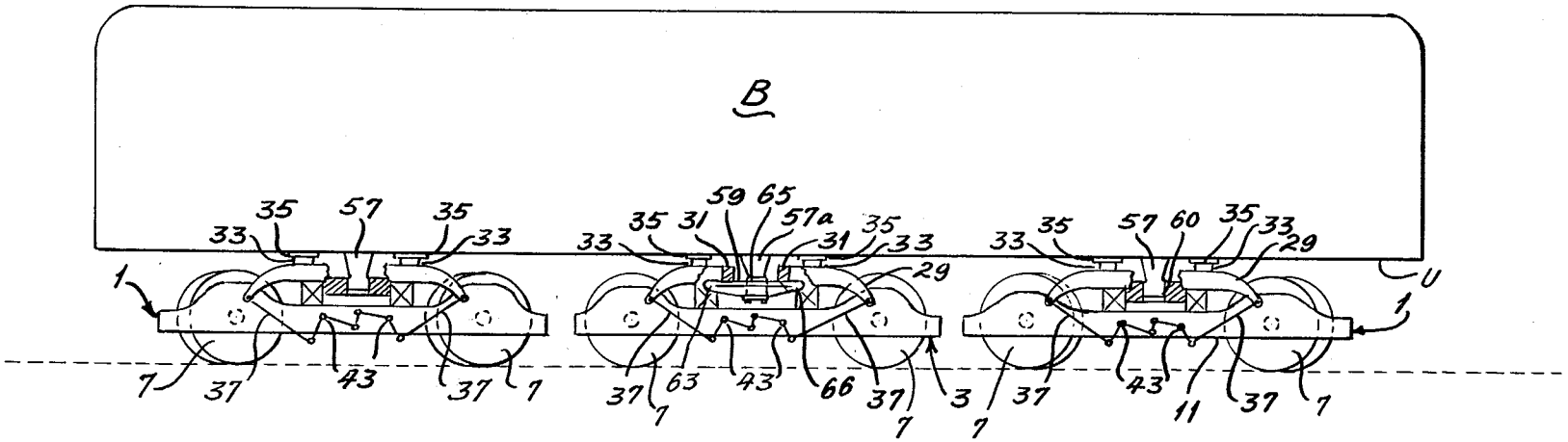
FIG. 2 is a side elevational view of a locomotive incorporating one embodiment of the invention.
Figure 3:
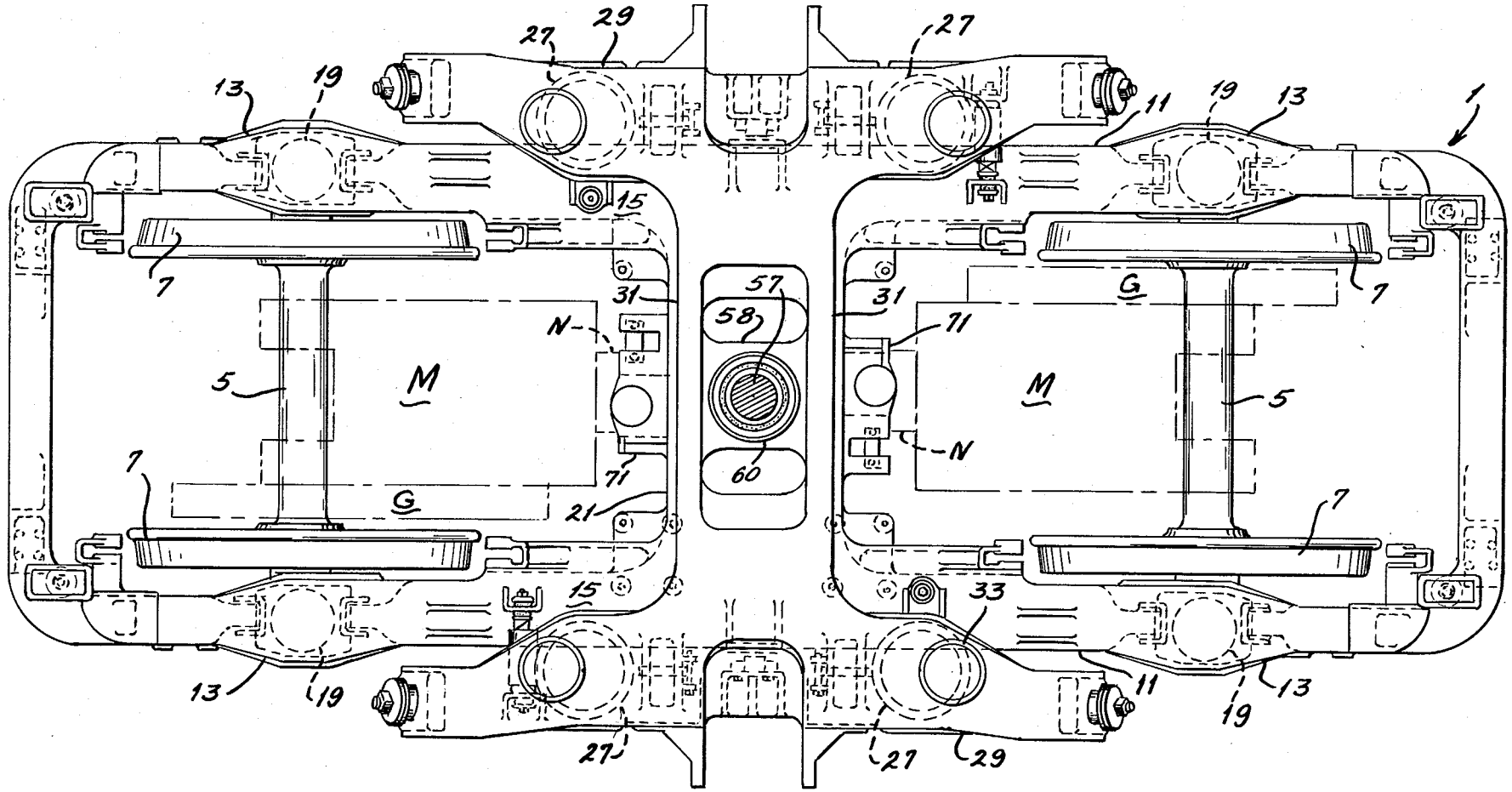
FIG. 3 is a plan view of one of the end trucks of the locomotive illustrated in FIG. 2.
Figure 4:
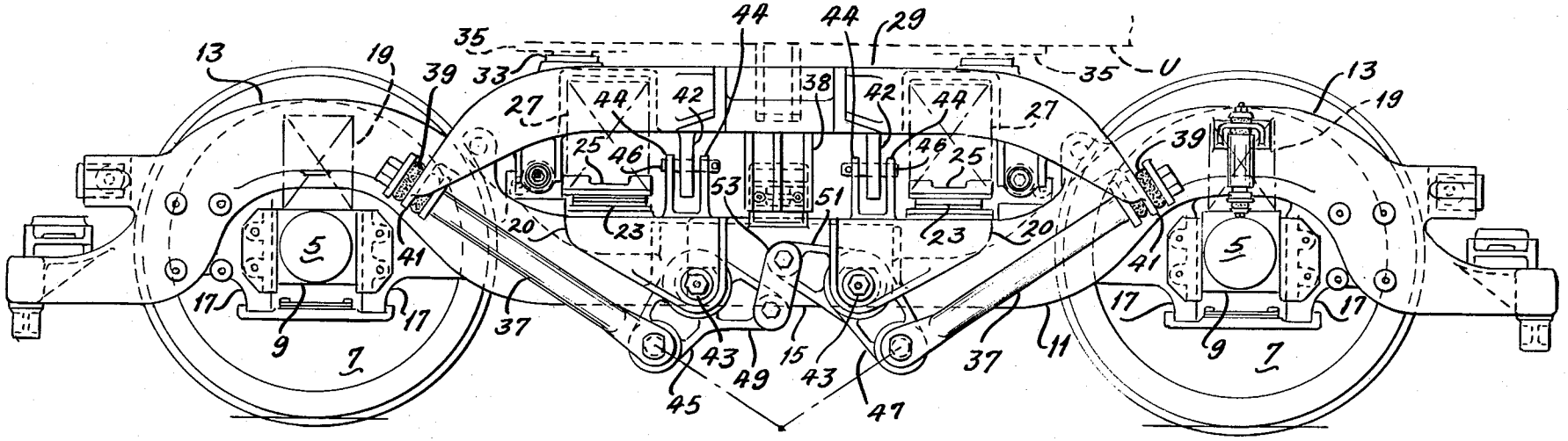
FIG. 4 is a side elevational view of the truck illustrated in FIG. 3.
Figure 5:
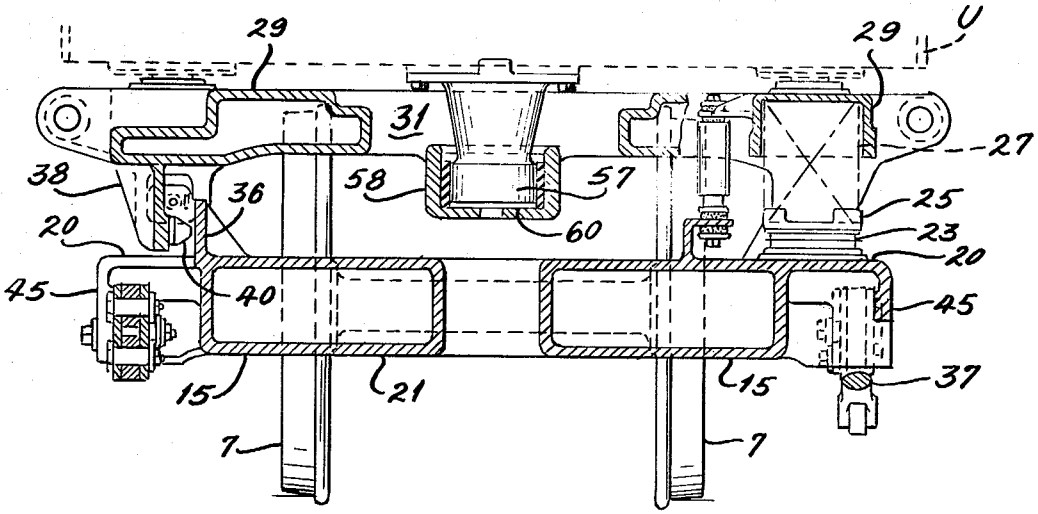
FIG. 5 is a transverse vertical sectional view taken along line 5—5 of FIG. 3.

As will be seen from FIG. 1, the end trucks 1 have fixed swivel centers on the center line of the body B but the intermediate truck 3 has a laterally movable swivel center through which traction forces are transmitted from the truck to the underframe but which accommodates sufficient lateral excursions of the truck with respect to the body to permit the locomotive to operate on curved track, during which the intermediate truck must move a substantial distance radially outwardly.

Referring now particularly to FIGS. 3–8, each end truck 1 has a pair of spaced axles 5 each mounting a gauged pair of railway flanged wheels 7, with journal boxes 9 rotatably receiving the ends of the axles outboard of the wheels.

A truck frame preferably of one-piece cast steel construction has a pair of longitudinally extending transversely spaced side members 11 positioned respectively outboard of the wheels with their end portions 13 arched over the axles and their intermediate portions depressed as at 15 and with downwardly open pedestal jaws 17 depending from the arched end portions 13 and slidably receiving journal boxes 9. Upright coil springs 19 extending upwardly from the journal boxes into the downwardly open hollow interiors of the arched portions 13 bear against the top wall of the latter to resiliently support the truck frame from the axles. The truck frame also includes a central transverse transom member 21 rigidly connecting the depressed portions 15 of the frame side members to form with them a rigid frame maintaining the axles in fully trammed relation with each other.

The upper walls of the depressed portion 15 of each of the frame side members 11, which are principally of box section, ar extended laterally outboard substantially throughout the length of the depressed portion 15 to form upwardly facing spring supporting brackets 20.

For resiliently supporting the underframe U on the truck frame and accommodating sufficient lateral movement therebetween to cushion the underframe from impacts received by the wheel flanges from lateral irregularities in the track rails, spring assemblies consisting of flat elastomeric pad devices 23 seated on the upper surfaces of side member depressed portion brackets 20 near the ends thereof, spring seats 25 supported on pad devices 23, and upright metal coil springs 27 seated in spring seats 25, support longitudinally extending bolster side members 29 which are rigidly connected to each other by a pair of longitudinally spaced transverse beams 31 to form a body-supporting bolster. Side members 29 of the bolster are formed with longitudinally spaced upwardly facing sliding bearing surfaces 33 immediately above springs 27, and locomotive underframe U is formed with opposing downwardly facing sliding bearings 35 in horizontal sliding engagement with bolster bearing surfaces 33, the longitudinal spacing of cooperating bearings 33, 35 serving to stabilize the bolster against tipping with respect to underframe U and maintaining the top surface of the bolster in substantial parallelism with the bottom of the underframe.

For limiting lateral movements of bolster 29 and 31 formed on the truck frame 11, 21 permitted through lateral shear in pad devices 23 and coil springs 27, upstanding brackets 36 at the center of frame side member depressed portions 15 and outwardly thereof, depending brackets 38 are formed on bolster side members 29 in transversely opposed relation with the respective brackets 36 and mount inwardly facing elastomeric bumpers 40 for limiting and cushioning lateral bolster movements.

For preventing vertical separation of the bolster and truck frame, each bolster side member is formed with a pair of depending apertured lugs 42, which extend between a pair of upstanding lugs 44 on the frame side member depressed portions 15 and a longitudinally extending pin 46 removably mounted in the upper ends of upstanding lugs 44 extends through the apertures in lugs 42, the apertures in lugs 42 being of sufficient size to accommodate all normal vertical and lateral movements of the bolster on the truck frame.

To prevent substantial axle-to-axle load transference which would occur if the effective point of transmission of longitudinal forces to the underframe were at a substantially high level as on conventional trucks, wherein the whole truck is tiltable about the high level center plate connection of the truck to the underframe, the bolster 29, 31 which is held against tilting with respect to the underframe by the longitudinal spacing of opposing bearings 33, 35, as described above, has traction force connections to the truck frame comprising downwardly converging links 37, the upper ends of which are connected at 39 to brackets 41 formed by the extended depending end portions of bolster side members 29. Connections 39 are constructed to permit slight pivotal movements of links 37 with respect to brackets 41 but to prevent any substantial longitudinal movements of the links 37 with respect to the brackets. The connection of links 37 to each truck frame side member depressed portion 15 comprises a pair of bell cranks fulcrumed on transverse pins 43 extending between depending flanges 45 on brackets 20 and the ouer walls of the side member depressed portions 15, pins 43 being spaced apart longitudinally of the truck. The beel cranks consist respectively of arms 45 and 47 pivotally connected at their lower ends to the lower ends of links 37 and normally extending generally upwardly perpendicular thereto, and additional arms 49 and 51 respectively extending generally toward each other from the respective fulcrum pins 43 with their inner ends in vertically lapped relation, and the inner ends are connected to each other by nearly vertical links 53 so that, in the event of vertical or lateral deflections of the bolster supporting springs 27 and pad devices 23, both bell cranks will move in unison and cause corresponding movements in opposite longitudinal directions of the lower ends of links 37 so as to maintain the latter in longitudinal force-transmitting condition between the truck frame and the bolster. As will be seen best from FIG. 4, the projections of the links 37 at each side of the truck preferably converge at rail level so that the effective point at which traction forces are transferred from the truck frame to the bolster and thence to the underframe is at rail level, thus eliminating ay vertical moment arm through which traction forces would otherwise operate to apply a vertical moment to the truck parts tending to increase the load on one axle and reduce the load on the other with consequent wheel slipping and loss of traction.

For providing a swivel center for the respective end trucks and transmitting longitudinal force from the bolsters thereof to the underframe U, a cylindrical bearing structure 57 depends from the underframe U through the opening defined between bolster transverse members 31, and the bolster transverse members 31, in turn, are connected by a longitudinal cross member 58 formed at the transverse and longitudinal center of the bolster with a cylindrical recess 60 in which is pivotally received cylindrical bearing structure 57, such that the end portions of the underframe are supported on the upwardly facing bearing surfaces 33 which, by their longitudinal spacing, prevent tipping of the bolster longitudinally of the truck. Some limited lateral movement of the bolster and underframe is accommodated with respect to the truck frame through transverse yielding of the pads 23 and upright bolster-supporting springs 27, sufficient to cushion lateral impacts on the wheel flanges from transverse irregularities in the track rails.

Figure 6:
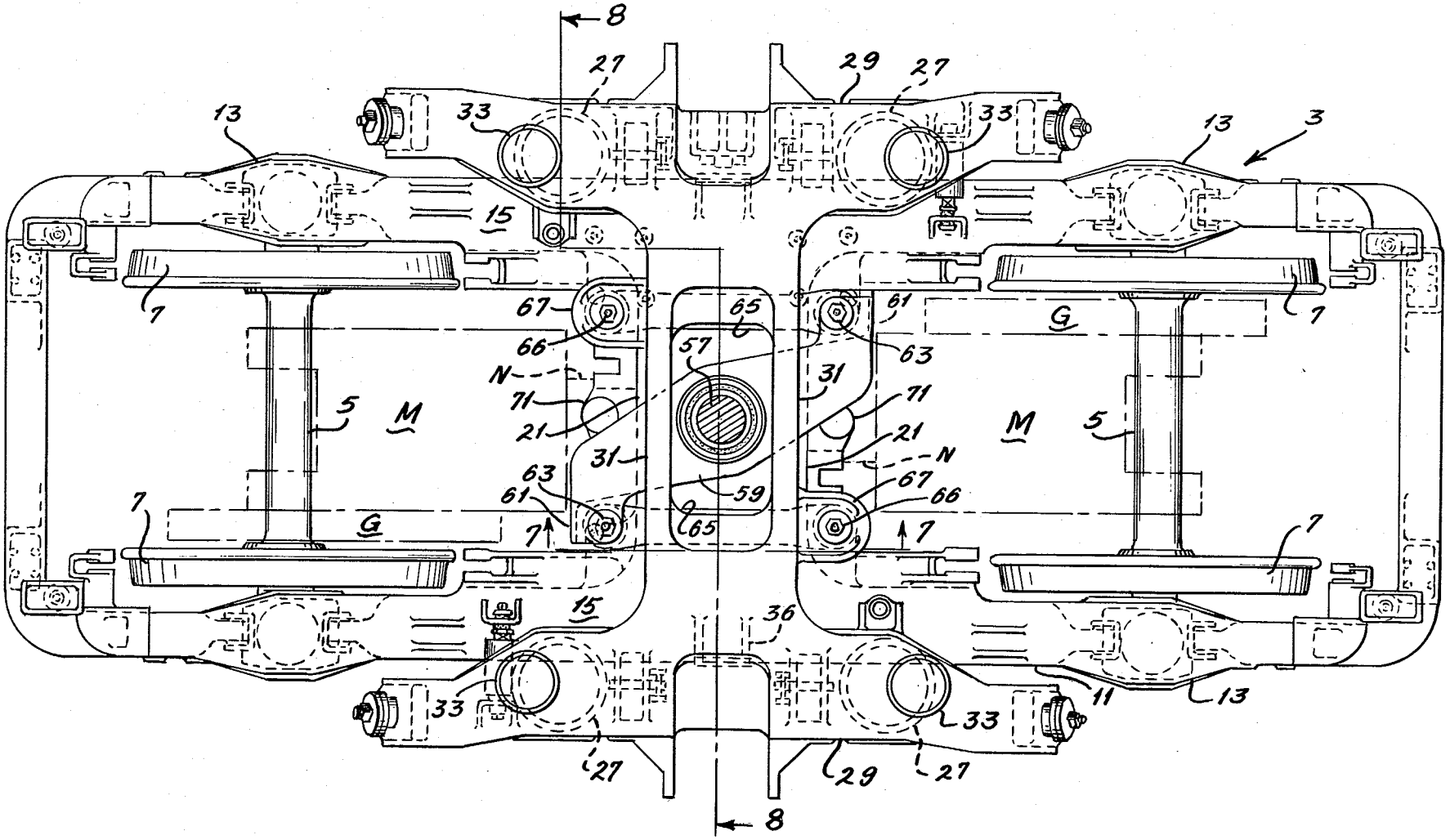
FIG. 6 is a plan view of the intermediate truck of the locomotive illustrated in FIG. 2.
Figure 7:
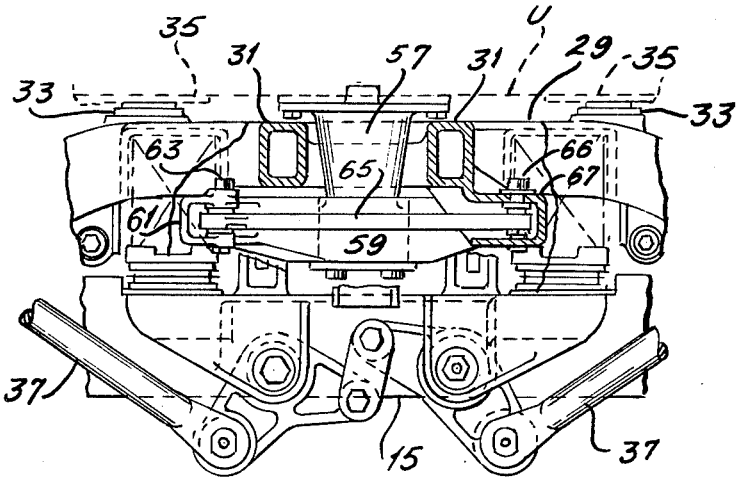
FIG. 7 is a fragmentary longitudinal vertical sectional view taken along line 7—7 of FIG. 6.
Figure 8:
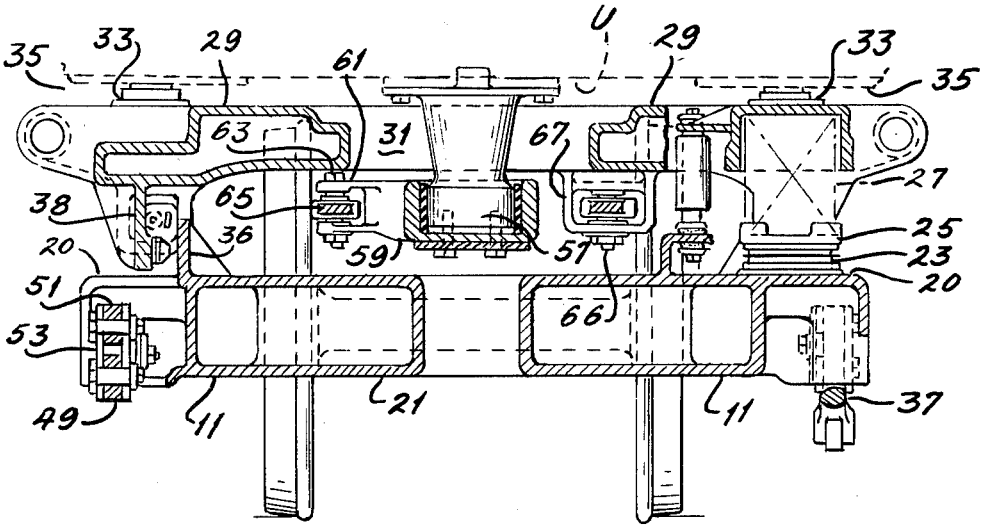
FIG. 8 is a transverse vertical sectional view taken along line 8—8 of FIg. 6.
Figure 9:
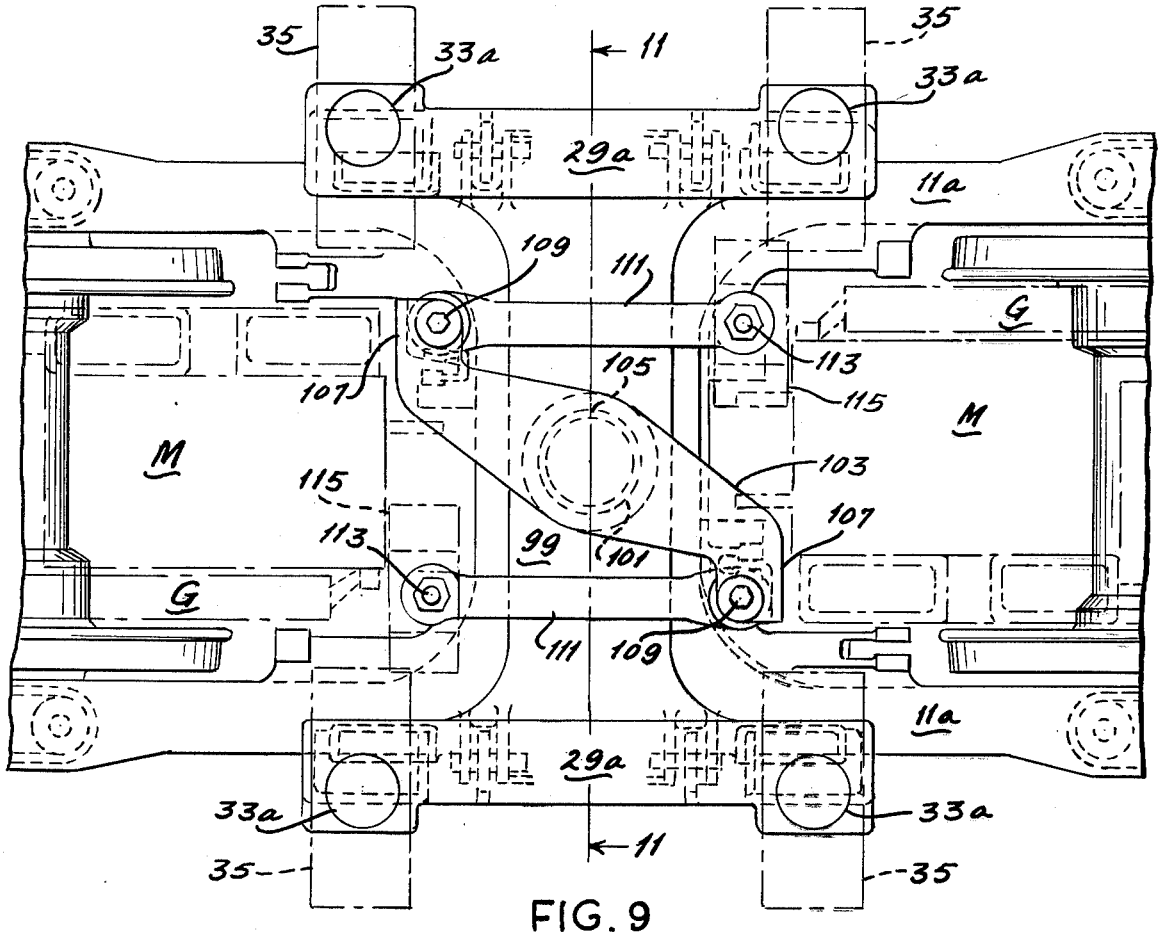
FIG. 9 is a partial top view of a second form of intermediate truck incorporating the invention.
Figure 10:
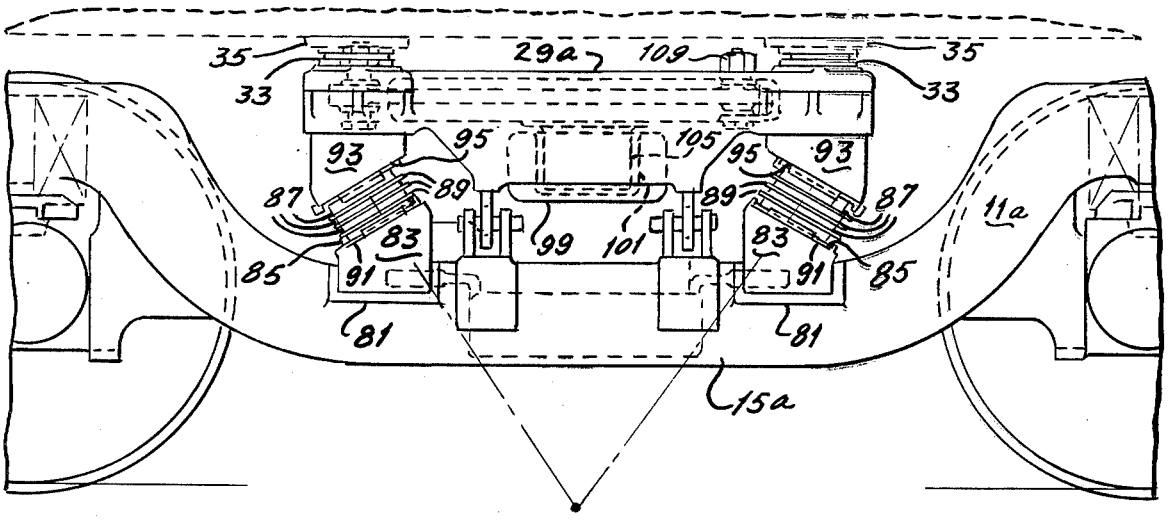
FIG. 10 is a partial side elevational view of the truck illustrated in FIG. 9.
Figure 11:
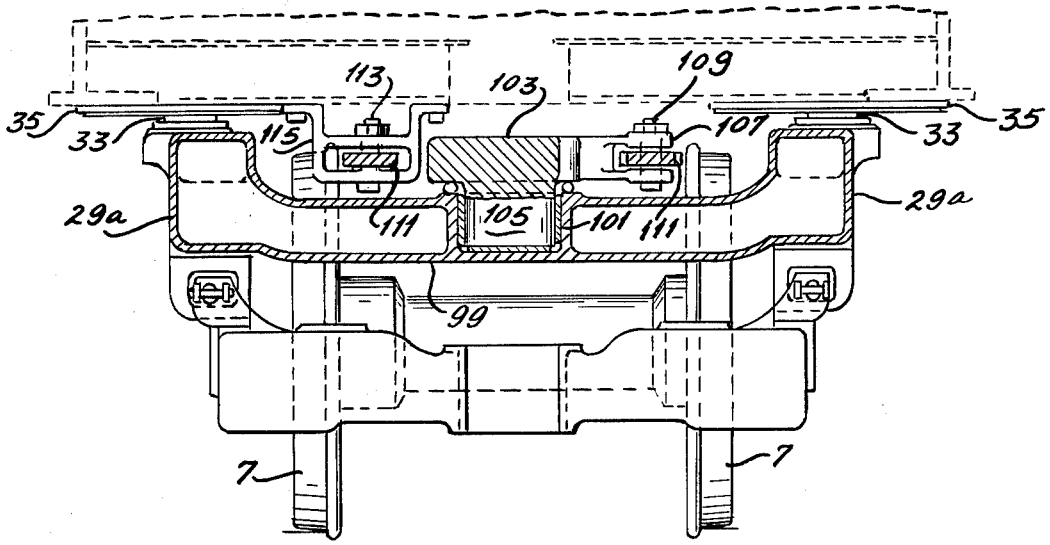
FIG. 11 is a transverse vertical sectional view taken along line 11—11 of FIG. 9.
Figure 12:
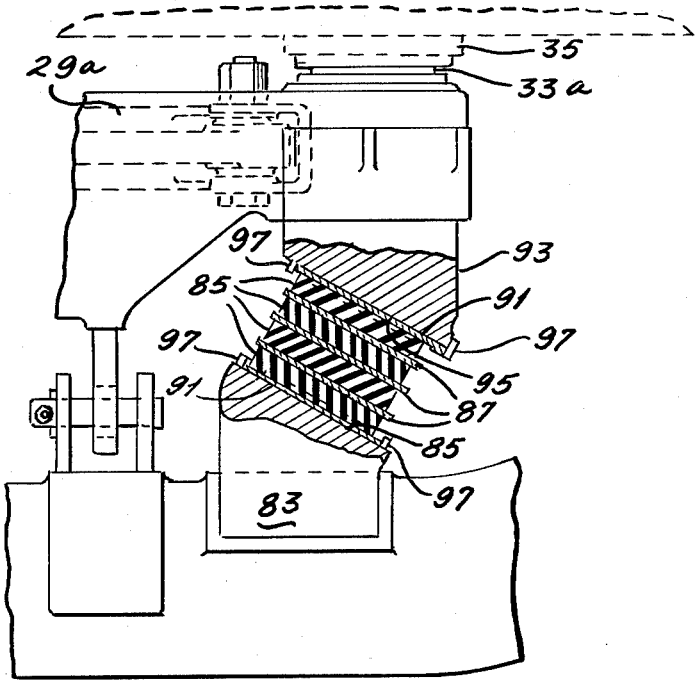
FIG. 12 is an enlarged fragmentary side elevational view partly sectionalized of the elastomeric bolster support device shown in FIG. 10.

Intermediate truck 3, best seen in FIGS. 6–8, is substantially identical to end trucks 1 and the same reference characters are used to denote the same parts. In the intermediate truck 3 longitudinal tie member 58 and bearing recess 60 therein are eliminated from the bolster and are replaced by a different type of swivel and longitudinal force-transmitting connection between the bolster and the underframe.

Since, as will be obvious from FIG. 1, it is essential that the intermediate truck 3 move a substantially greater distance than end trucks 1 transversely of the underframe while operating on curved track, and since it is not feasible to provide sufficient lateral movement of the bolster with respect to the truck frame to accommodate the large lateral excursions required for the intermediate truck on curved track, the underframe U preferably mounts at its center a third depending cylindrical bearing structure 57 which extends through the opening defined between bolster transverse members 31 and therebelow pivotally mounts a diagonally extending horizontal lever 59 which underlies bolster transverse members 31 and overlies truck frame transom 21. The terminals 61 of diagonal lever 59 are rebent longitudinally outwardly of bolster transverse members 31 to extend substantially transversely of the truck and are of clevis formation to pivotally receive at 63 one end of longitudinally extending draft links 65, each of which extends longitudinally of the truck beneath the bolster transverse members 31 and above truck frame transom 21 and are at their opposite ends pivotally connected at 66 to clevis brackets 67 extending outwardly longitudinally of the truck from the respective bolster transverse members 31. It will be seen from the foregoing and from the accompanying drawings that this arrangement accommodates necessary transverse movements of the intermediate truck and bolster as shown in FIG. 1, through pivoting of draft links 65 about their respective connections to the lever 59 and bolster brackets 67 without any substantial movement longitudinally of the truck with respect to the underframe because of the accompanying pivotal movement of lever 59 about the cylindrical bearing 57. Thus traction forces will be transmitted from the truck to the underframe at all times irrespective of lateral excursions of the truck with respect to the underframe caused by curved track operation.

For driving both the end trucks 1 and intermediate truck 3 each of the axles 5 mounts a parallel traction motor M through motor bearings journaled on the axle and each motor casing has a nose N supported frame suitable brackets 71 on truck frame center ransom member 21 to provide a reaction connection to the truck frame. Each motor is drivingly connected to the respective axle 5 by a gear box G, it being understood that traction forces generated between the axles and rail heads at their points of contact are transmitted from the axles through the journal boxes and pedestal jaws to the truck frame and thence through the bellcranks and converging traction links 37 to the bolster, the effective point of transmission being at the intersection, at rail level, of the projections of the longitudinal axes of the traction links 37. Since tilting of the bolster about a transverse axis with respect to the underframe is prevented by the engagement of the longitudinally spaced opposed bearings 33, 35 on the bolster and underframe, the point at which longitudinal tilt of the truck frame needed to accommodate to vertical curvature of the track is at the intersection of the traction link projections, i.e., at rail level, so that there is no moment arm about which the longitudinal forces generated between the wheels and the rail heads may act to transfer load from axle to axle, and thus axle-to-axle load transference is minimal.

Operation of a locomotive constructed in accordance with the invention is as follows: During movement along tangent track, caused by motors M rotating axles 5 of each of the trucks, axle-to-axle load transference on each truck is minimized by reason of the fact that the traction forces generated at the points of engagement between the wheels and rails are effectively transmitted to the underframe at the same level by reason of the intersection at that level of the projections of the longitudinal axes of traction links 37 and because the bolsters are held against tilting with respect to the underframe by engagement of the longitudinally spaced pairs of opposed bearings 33, 35. At the same time, any lateral impacts transmitted to the wheel flanges and thence to the truck frames by transverse irregularities in the track rails are cushioned by the lateral resiliency of spring devices 23, 25, 27, particularly by the yielding in shear of the elastomeric pad devices 23 so that no such lateral impacts are transmitted to the truck bolsters and thence to the underframe U with respect to which the bolsters of the end trucks are held against transverse movement by the mating relationship of underframe depending cylindrical bearing structures 57 and the cooperating cylindrical bearing recess 60 in bolster longitudinal tie members 58. Upon entering curved track in which the center line of the locomotive connecting the pivot bearings 57, 60 of the end trucks forms a chord of the track curve center line, displacement transversely of the locomotive of the center truck so that its center lies on the arc of curvature rather than on the chord, is accommodated by the action of the linkage wherein the connections of the draft links 65 at 63 to the intermediate bolster transverse members 31 move outwardly transversely of the underframe, and their connections to the lever 59 at 61 are permitted to move correspondingly by pivotal movements of lever 59 about the intermediate underframe depending cylindrical bearing structure 57, longitudinal forces being transmitted from the middle truck through draft links 65, lever 59 and cylindrical bearing structure 57 to the underframe on the center line thereof, thus applying no substantial lateral or radial forces to the underframe but only transmitting longitudinal driving forces corresponding to those transmitted from the end trucks to the underframe.

In the embodiment of the invention illustrated in FIGS. 9–12, both the end and intermediate truck structures are similar in many respects to those of the first embodiment and where identical or closely similar parts ae used the same reference numbers are applied, different reference numbers being applied to parts substantially different from those of the first embodiment.

In the second embodiment, the depressed center portion 15*a* of each side member 11*a* of the truck frame is formed with a pair of outboard brackets in the form of upwardly and outwardly open shelves 81, in which are seated bearing blocks 83 having their upper surfaces 85 inclined in a direction longitudinal of the truck such that the central normals of surfaces 85 intersect near rail level substantially at the intersection of the transverse central plane of the truck with the rails. Flat elastomeric pad devices each comprising a plurality of flat elastomeric pads 87 separated by metal plates 89 and bounded by metal plates 91 and are seated on sloping surfaces 85 and the side members 29*a* of a body supporting bolster are formed with depending feet 93 at their ends, feed 93 having downwardly facing surfaces 95 sloping parallel to upwardly facing surfaces 85 on bearing blocks 83 and seated on the upper boundary plates 91 of the elastomeric pad devices 87, 89, 91. For fixing the position of the elastomeric pad devices on sloping surfaces 85 and 95 suitable parapets 97 are formed on these surfaces for engagement with the edges of the top and bottom boundary plates 91 of the pad devices.

In both end and intermediate trucks, the bolster side members 29*a* are rigidly connected to each other by a single transversely extending center member 99 formed at its center with an upwardly open cylindrical recess 101.

In the intermediate truck a diagonally extending lever 103 is formed with a cylindrical bearing boss 105 pivotally received in recess 101 and seated on the bottom thereof, and the terminals of diagonally extending lever 103 are rebent to extend transversely of the truck and define clevises 107 in which are pivotally received at 109 one end each of a pair of draft links 111 which normally extend longitudinally of the truck from their connection at 109 to lever 103 to a pivotal connection at 113 to clevis brackets 115 on the underframe.

Immediately above elastomeric pad devices 87, 89, 91 the bolster side members 29*a* are formed with longitudinally spaced upwardly facing sliding bearing surfaces 33*a* for opposing sliding engagement with downwardly facing sliding bearings 35 on the locomotive underframe U.

The end trucks are identical to the intermediate truck described above except that the Watts linkage connection to the underframe is eliminated and the underframe is formed near each end on its longitudinal center line with a depending cylindrical bearing structure 57 which is pivotally received in bolster recess 101.

Operation of a locomotive constructed according to the second embodiment of the invention is as follows: On tangent track on which the locomotive body structure and underframe are aligned with the truck, traction forces in the individual trucks are transmitted from the wheels through the axles and journal boxes into the pedestal legs and thence into the truck frame and from the truck frame via elastomeric sandwich devices 87, 89 to the truck bolster 29*a*, 39*a*, the effective level of traction transmission being substantially at rail level because of the inclination of pad devices 87, 89 and the convergence of their central normals substantially at rail level. Since each of the bolsters is held against tipping about a transverse axis with respect to the truck frame by the enagement of bolster bearing surfaces 33 and underframe downwardly facing surfaces 35, the pad devices 87, 89 permit relative tipping of the truck frame about a transverse axis necessary to accommodate vertical track curvature about an effective fulcrum at the rail-level intersection of the central normals of the pad devices, thus eliminating the vertical moment arm, through which traction forces applied to the truck at rail level would otherwise act to reduce the loading on the leading axle and increase loading on the trailing axle, and thus minimize such axle-to-axle load transference. As the locomotive continues movement along curved track, the end trucks transmit traction forces to the underframe through the cylindrical bearings 57 in cooperation with the cooperating bearing recesses in the end truck bolsters and the intermediate truck, though offset laterally from the locomotive center line, transmits traction forces to the underframe through the Watts linkage device wherein one of the Watts links is under compression and the other under tension depending upon the direction of movement.

The details of the invention described herein may be varied substantially without departing from the spirit of the invention and the exclusive use of such modifications as come within the scope of the appended claims is contemplated.

I claim:

1. In a railway locomotive, at least three load bearing trucks spaced apart lengthwise of the locomotive and comprising a pair of end trucks and at least one intermediate truck, each of said trucks having a pair of longitudinally spaced-apart wheeled axles, a truck frame resiliently supported on said axles, each of said end trucks having a bolster resiliently supported on its frame for vertical and transverse cushioning movements with respect thereto, said intermediate truck having bolster structure resiliently supported on its frame for vertical and transverse movements with respect thereto, each of said end trucks having a traction transmitting connection between its frame and its bolster, said intermediate truck having a traction transmitting connection between its frame and its bolster structure, all of said traction transmitting connections being effective substantially at rail level, elongated underframe structure, means supporting said underframe structure on said bolsters and said bolster structure and preventing longitudinal tiling of said bolsters and bolster structure relative to said underframe structure, said underframe structure and the bolsters of each of said end trucks having fixed cooperating vertical axis swivel bearings accommodating solely relative swiveling movements of said end truck bolsters with respect to said underframe structure, and transversely yieldable longitudinally unyielding means connecting said intermediate truck bolster structure and said underframe structure for transmitting longitudinal forces from said intermediate truck bolster structure to said underframe structure and accommodating substantial lateral excursions of said intermediate truck bolster structure with respect to said underframe structure as may be required for operation of the locomotive on curved track, said swivel bearings and said connecting means cooperating with said underframe structure supporting means and said traction transmitting connections to maintain the effective level of traction transmission from said trucks to said underframe structure substantially at rail level whereby to minimize axle-to-axle load transference in each of said trucks while minimizing development of lateral components of traction forces in any of said traction transmitting connections.

2. In a railway locomotive according to claim 1, said means supporting said underframe structure from said end truck bolsters and intermediate truck bolster structure comprising at least two vertically substantially rigid upwardly facing bearings spaced apart longitudinally of the respective truck on each of said bolsters and bolster structure, and downwardly facing bearings on said underframe structure in opposed relation with said upwardly facing bearings.

3. In a railway locomotive according to claim 2, longitudinally spaced resilient elements supporting said bolster and bolster structure from the respective truck frame at each side of the truck, there being a pair of said longitudinally spaced bearings at each side of the truck in substantial vertical alignment with the respective resilient elements.

4. In a railway locomotive according to claim 1, said connecting means comprising a linkage having a transversely extending lever fulcrumed on one of said structures and a pair of links connected respectively at one end to the ends of said lever and extending in opposite directions therefrom longitudinally of the truck and connected at their opposite ends to the other of said structures.

5. In a railway locomotive according to claim 4, said transverse lever being fulcrumed on said underframe structure and the opposite ends of said links being pivotally connected to said bolster structure.

6. In a railway locomotive according to claim 4, said transverse lever being fulcrumed on said bolster structure and the opposite ends of said links being pivotally connected to said underframe structure.

7. In a railway locomotive according to claim 6, said means supporting said underframe structure on said bolsters and said bolster structure respectively comprising pairs of upwardly facing bearing surfaces on the respective bolsters and bolster structure spaced apart the same distance longitudinally of the truck substantially as said elastomeric pad devices.

8. An intermediate truck according to claim 7 wherein said means supporting the underframe structure from said truck bolster structure comprises at least two vertically substantially rigid upwardly facing bearings spaced apart longitudinally of the truck on said bolster structure and downwardly facing bearings on the underframe structure in opposed relation with said upwardly facing bearings.

9. In a railway locomotive according to claim 4, upright springs seated on the truck frame at each side thereof and supporting said bolster and said bolster structure on the respective truck frames, said means supporting said underframe structure on said bolsters and said bolster structure respectively comprising pairs of upwardly facing bearing surfaces on the respective bolsters and bolster structure spaced apart the same distance longitudinally of the truck substantially as said elastomeric pad devices.

10. In a railway locomotive according to claim 4, said traction transmitting connections comprising a pair of upwardly facing surfaces on each side of each truck frame spaced apart longitudinally of the truck and inclined longitudinally of the truck such that their normals intersect near rail level, downwardly facing surfaces on said bolster and said bolster structure respectively substantially parallel with said upwardly facing surfaces and in opposed spaced relation therewith, and flat elastomeric pad devices between said upwardly and downwardly facing surfaces with their central normals intersecting near rail level.

11. In a railway locomotive according to claim 1, a pair of upright springs spaced apart longitudinally of the truck frame at each side thereof supporting said bolster and said bolster structure on the truck frame, said traction transmitting connections between the respective truck frames and said bolsters of said end trucks and said bolster structure of said intermediate truck comprising a pair of longitudinally extending links pivotally connected at their upper ends to the respective bolster and bolster structure and at their lower ends to said truck frames, said traction links being inclined longitudinally of the truck such that the projections of their longitudinal axes intersect near rail level.

12. In a railway locomotive according to claim 10, said means supporting said underframe structure on said bolsters and said bolster structure comprising pairs of upwardly facing bearing surfaces on the respective bolsters and bolster structure spaced apart substantially the same distance longitudinally of the truck as said upright springs.

13. In a railway locomotive according to claim 1, said traction transmitting connections comprising a pair of upwardly facing surfaces on each side of each truck frame spaced apart longitudinally of the truck and inclined longitudinally of the truck such that their normals intersect near rail level, downwardly facing surfaces on said bolster and said bolster structure respectively substantially parallel with said upwardly facing surfaces and in opposed spaced relation therewith, and flat elastomeric pad devices between said upwardly and downwardly facing surfaces with their central normals intersecting near rail level.

14. An intermediate truck for a railway locomotive having at least three swivel trucks comprising a pair of longitudinally spaced-apart wheeled axles and underframe structure supported thereon, a truck frame resiliently supported on said axles, bolster structure resiliently supported on said truck frame for vertical and transverse cushioning movements with respect thereto, traction transmitting connections between said truck frame and said bolster structure effective substantially at rail level, means for supporting said underframe structure on said bolster structure and preventing longitudinal tilting of said bolster structure relative to said underframe structure, and laterally yieldable but longitudinally unyielding means connecting said bolster structure and the underframe structure for transmitting longitudinal forces from said truck to the underframe structure and accommodating substantial lateral excursions of said bolster structure with respect to the underframe structure as may be required for operation of the locomotive on curved track, said connecting means cooperating with said underframe, structure supporting means and said traction transmitting connections to maintain the effective level of traction transmission from the truck to said underframe structure substantially at rail level whereby to minimize axle-to-axle load transference in the truck while minimizing development of lateral components of traction forces in said traction transmitting connections.

15. An intermediate truck according to claim 14 wherein said connecting means comprises a linkage having a transversely extending lever fulcrumed on one of said structures and a pair of links connected respectively at one end to the ends of said lever and extending in opposite directions therefrom longitudinally of the truck and connected at their opposite ends to the other of said structures.

16. An intermediate truck according to claim 14 wherein said lever is fulcrumed on structure depending from the underframe structure and said links are connected at their opposite ends to said bolster structure.

17. An intermediate truck according to claim 14 wherein said lever is fulcrumed on said bolster structure and said links are adapted for connection at their opposite ends to said underframe structure.

18. An intermediate truck according to claim 14 having a pair of upright springs spaced apart longitudinally of the truck frame at each side thereof supporting said bolster structure on the truck frame, wherein said traction transmitting connections between the truck frame and said bolster structure comprise a pair of longitudinally extending links pivotally connected at their upper ends to said bolster structure and at their lower ends to said truck frame, said traction links being inclined longitudinally of the truck such that the projections of their longitudinal axes intersect near rail level.

19. An intermediate truck according to claim 14 wherein said traction transmitting connections comprise a pair of upwardly facing surfaces on each side of said truck frame spaced apart longitudinally of the truck and inclined longitudinally of the truck such that their normals intersect near rail level, downwardly facing surfaces on said bolster structure respectively substantially parallel with said upwardly facing surfaces and in opposed spaced relation therewith, and flat elastomeric pad devices between said upwardly and downwardly facing surfaces with their central normals intersecting near rail level.

20. An intermediate truck according to either of claims 18 or 19 wherein said means connecting said bolster structure to the underframe structure comprises a linkage having a transversely extending lever fulcrumed on one of said structures and a pair of links connected respectively at one end to the ends of said lever and extending in opposite directions therefrom longitudinally of the truck and connected at their opposite ends to the other of said structures.

21. An intermediate truck according to claim 20 wherein said means supporting the underframe structure from said truck bolster structure includes a pair of vertically substantially rigid upwardly facing bearings spaced apart longitudinally of the truck on said bolster structure and downwardly facing bearings on the underframe structure in opposed relation with said upwardly facing bearings.

* * * * *